US007490955B1

(12) United States Patent
Lai

(10) Patent No.: US 7,490,955 B1
(45) Date of Patent: Feb. 17, 2009

(54) LED LAMP

(75) Inventor: Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 0 days.

(21) Appl. No.: 11/964,826

(22) Filed: Dec. 27, 2007

(30) Foreign Application Priority Data

Nov. 6, 2007 (CN) ..... 2007 1 0202398

(51) Int. Cl.
*F21V 21/00* (2006.01)

(52) U.S. Cl. ..... 362/235; 362/249; 362/374; 362/375

(58) Field of Classification Search ..... 362/235, 362/249, 374, 375
See application file for complete search history.

(56) References Cited

U.S. PATENT DOCUMENTS 5,222,799 A * 6/1993 Sears et al. ..... 362/146
6,582,103 B1 * 6/2003 Popovich et al. ..... 362/307
6,971,767 B2 * 12/2005 Agabekov et al. ..... 362/249
7,235,305 B2 * 6/2007 Hasskerl et al. ..... 428/447

* cited by examiner

*Primary Examiner*—Thomas M Sember
(74) *Attorney, Agent, or Firm*—D. Austin Bonderer

(57) ABSTRACT

An LED lamp includes a lamp seat, a lampshade and a plurality of LED modules. The lamp seat defines a groove thereof. The lampshade covers the lamp seat and forms a protrude portion slidably engaged in the groove of the lamp seat. The LED modules are received in the lamp seat for emitting light out from the lampshade.

10 Claims, 5 Drawing Sheets

LED LAMP

BACKGROUND OF THE INVENTION

1. Field of the Invention

The present invention relates to an LED lamp, and particularly to an LED lamp having simple assembling and disassembling structure.

2. Description of Related Art

The technology of light emitting diodes has rapidly developed in recent years from indicators to illumination applications. With the features of long-term reliability, environment friendliness and low power consumption, the LED is viewed as a promising alternative for future lighting products, particularly to street lamps. Over time street lamps accumulate a lot dust inside and out. In this state, the street lamp has to be disassembled in order to clean the dust particles. Generally, a structure of the street lamp is complicated that it is unduly time-consuming to disassemble and assemble the street lamp.

Therefore, a new LED lamp which has a simple assembling and disassembling structure is desired to overcome the above described shortcomings.

SUMMARY OF THE INVENTION

An LED lamp includes a lamp seat, a lampshade and a plurality of LED modules. The lamp seat defines a groove thereof. The lampshade covers the lamp seat and forms a protrude portion slidably engaged in the groove of the lamp seat. The LED modules are received in the lamp seat for emitting light out from the lampshade.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
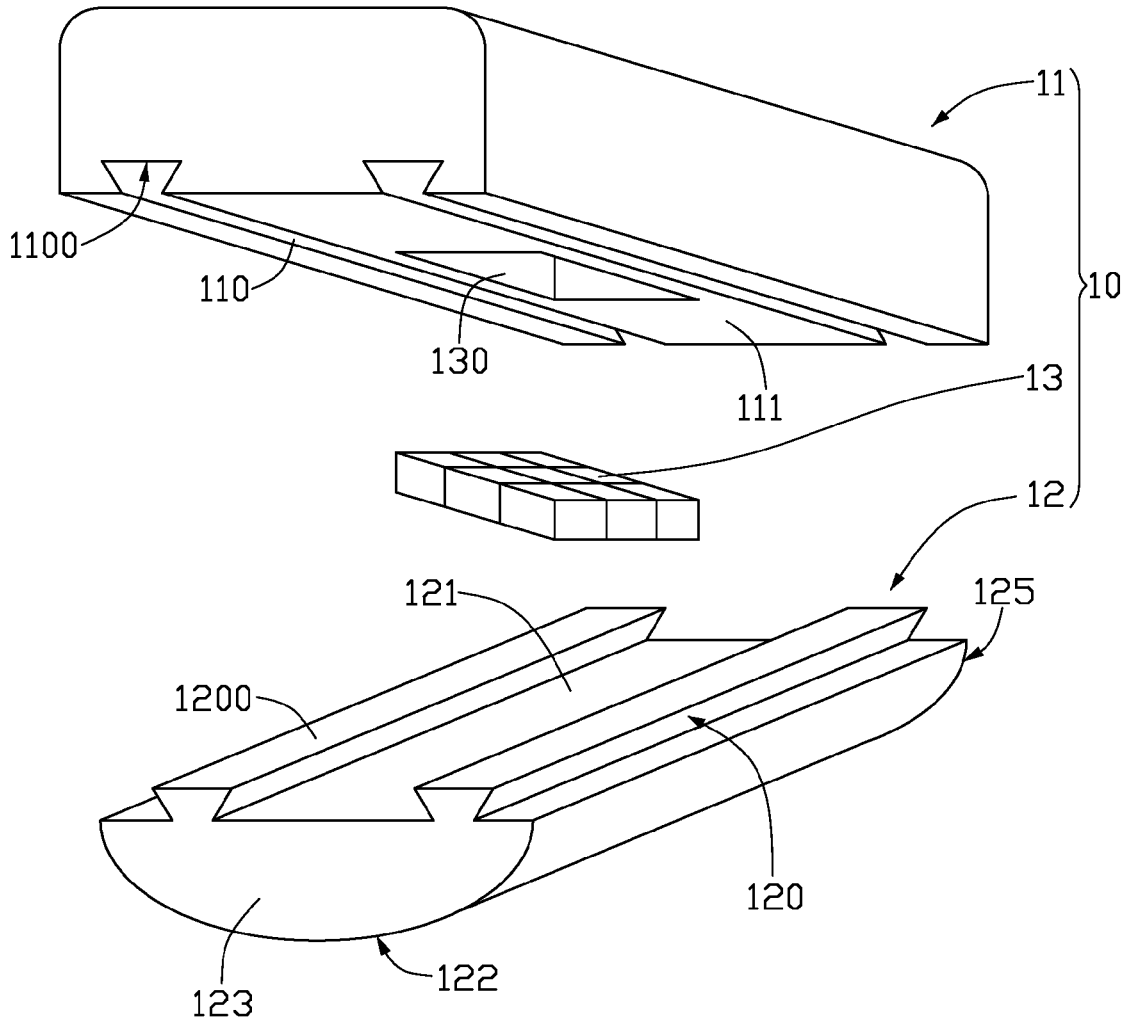
FIG. 1 is an exploded view of an LED lamp in accordance with a first embodiment of the present invention.
Figure 2:
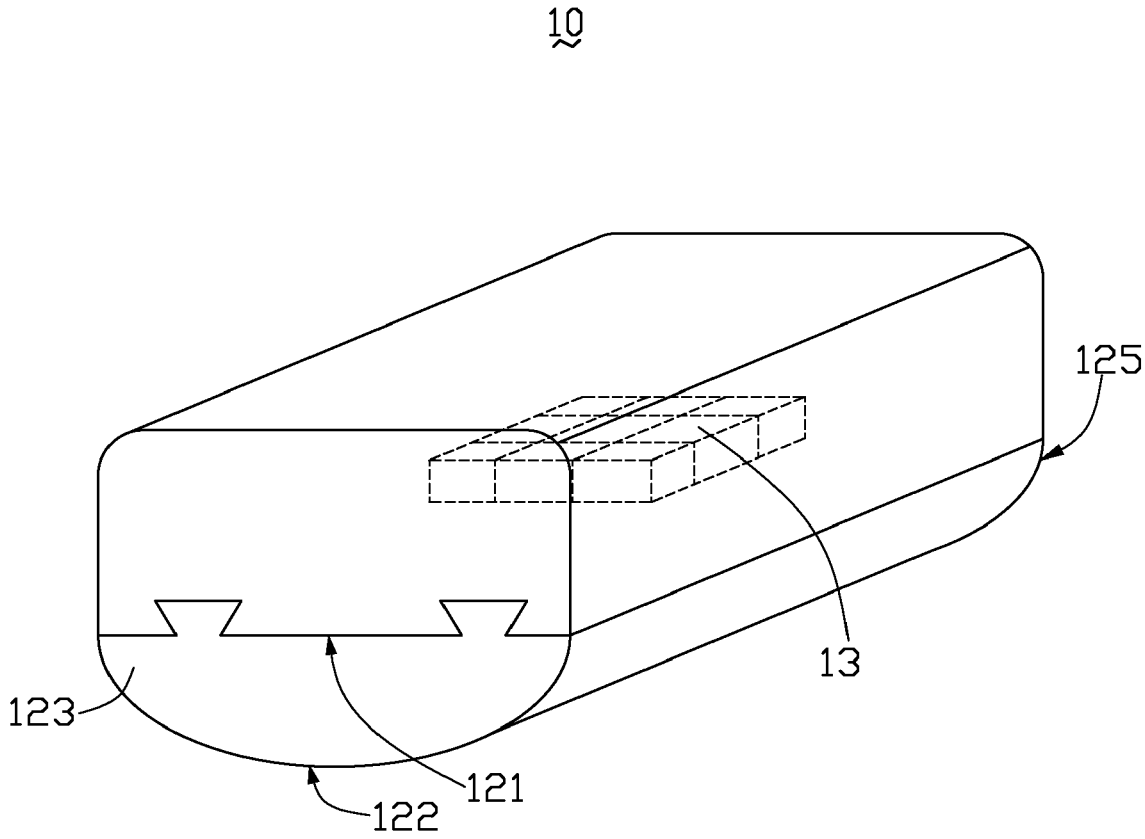
FIG. 2 is an assembled view of FIG. 1.

Referring to FIGS. 1-2, an LED lamp 10 of a first embodiment of the invention comprises a lamp seat 11, a plurality of LED modules 13 received in the lamp seat 11 and a lampshade 12 corresponding to the lamp seat 11.

The lamp seat 11 is a cuboid and has an elongated bottom surface 111. The lamp seat 11 defines a receiving chamber 130 at a centre thereof. The LED modules 13 are received in the receiving chamber 130. A bottom surface (not labeled) of the LED modules 13 and the bottom surface 111 of the lamp seat 11 are coplanar. The lamp seat 11 defines two spaced grooves 110 at opposite sides thereof. Each groove 110 has a trapeziform cross section, and a distance between two opposite inner sides of the each groove 110 at upper portion is larger than that each groove 110 at lower portion. Each groove 110 has an elongated top surface 1100.

A material of the lampshade 12 is selected from polymethylmethacrylate, poly carbonate, silicone, epoxy and polycrylate or a glass containing a mixture of ZnO, $B_2O_3$, $SiO_2$, $Nb_2O_5$, $Na_2O$, or $Li_2O_5$. The lampshade 12 has a transmission rate greater than 90% and a refraction rate between 1.4 and 1.7. A length of the lampshade 12 equals to the length of the lamp seat 11. The lampshade 12 has an arc-shaped configuration and comprises an elongated flat top surface 121, an arc-shaped bottom surface 122, an arc-shaped front surface 123 and an arc-shaped rear surface 125. The front and rear surfaces 123, 125 are located at opposite ends of the lampshade 12 and connect with the top and bottom surfaces 121, 122. Light emitted from the LED modules 13 can travel to an ambient from the top surface 121 and the bottom surface 122. The front and rear surfaces 123, 125 are substantially coated with reflective films (not shown). The front and rear surfaces 123, 125 function as two reflectors to reflect light produced by the LED modules 13, thus light travel through the bottom surface 122 is accumulated in a determined circumstance to enhance a luminance of the determined circumstance.

Figure 3:
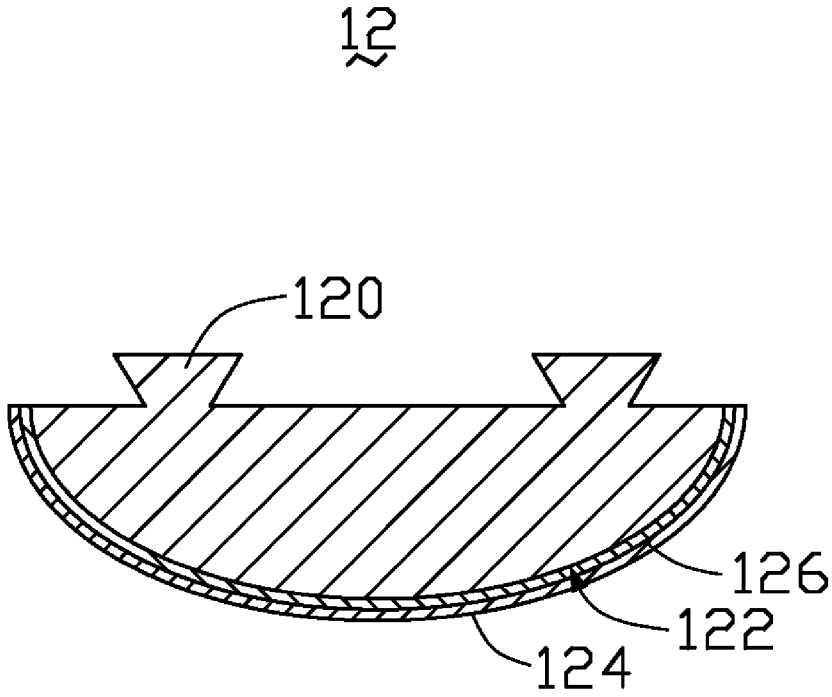
FIG. 3 is a cross sectional view of a lampshade of the LED lamp of FIG. 1.

Referring to FIG. 3 also, a transparent layer 126 is formed on an outside of the bottom surface 122 and a photosensitive layer 124 is formed on an outside of the transparent layer 126. The transparent layer 126 is made from silicon or $Al_2O_3$. The transparent layer 126 is used to prevent the photosensitive layer 124 from directly contacting with the bottom surface 122. The photosensitive layer 124 generates super-hydrophilicity after absorbing UV rays emitted by the sun so that when rainwater contacts the photosensitive layer 124, it can easily enters a gap between the contaminations and the photosensitive layer 124 to clear up the contaminations.

Two spaced protruding portions 120 protrude from the top surface 121 of the lampshade 12. Each protruding portion 120 has a shape corresponding to each groove 110. Each protruding portion 120 comprises an elongated top surface 1200 parallel to the top surface 121 of the lampshade 12 and two side surfaces (not labeled) extending downwardly from opposite edges of the top surface 1200 to the top surface 121 of the lampshade 12. The protruding portions 120 can slide along the grooves 110 of the lamp seat 11.

In assembly, the protruding portions 120 slide along the grooves 110 of the lamp seat 11 until the protruding portions 120 being fully engaged in the grooves 110; thus, the lamp seat 11 and the lampshade 12 are assembled together. In this state, the top surfaces 1200 of protruding portion 120 and the top surfaces 1100 of the grooves 110 have an intimate contact with each other and the bottom surface 111 of the lamp seat 11 and the top surface 121 of the lampshade 12 have an intimate contact with each other to prevent air and dust particles from entering therebetween. A silica gel layer (not shown) can be disposed between the top surfaces 1200 of the protruding portion 120 and the top surfaces 1100 of the grooves 110 to increase friction of the groove 110 and the protruding portion 120, allowing the protruding portion 120 to further intimately engaging in the groove 110.

Figure 4:
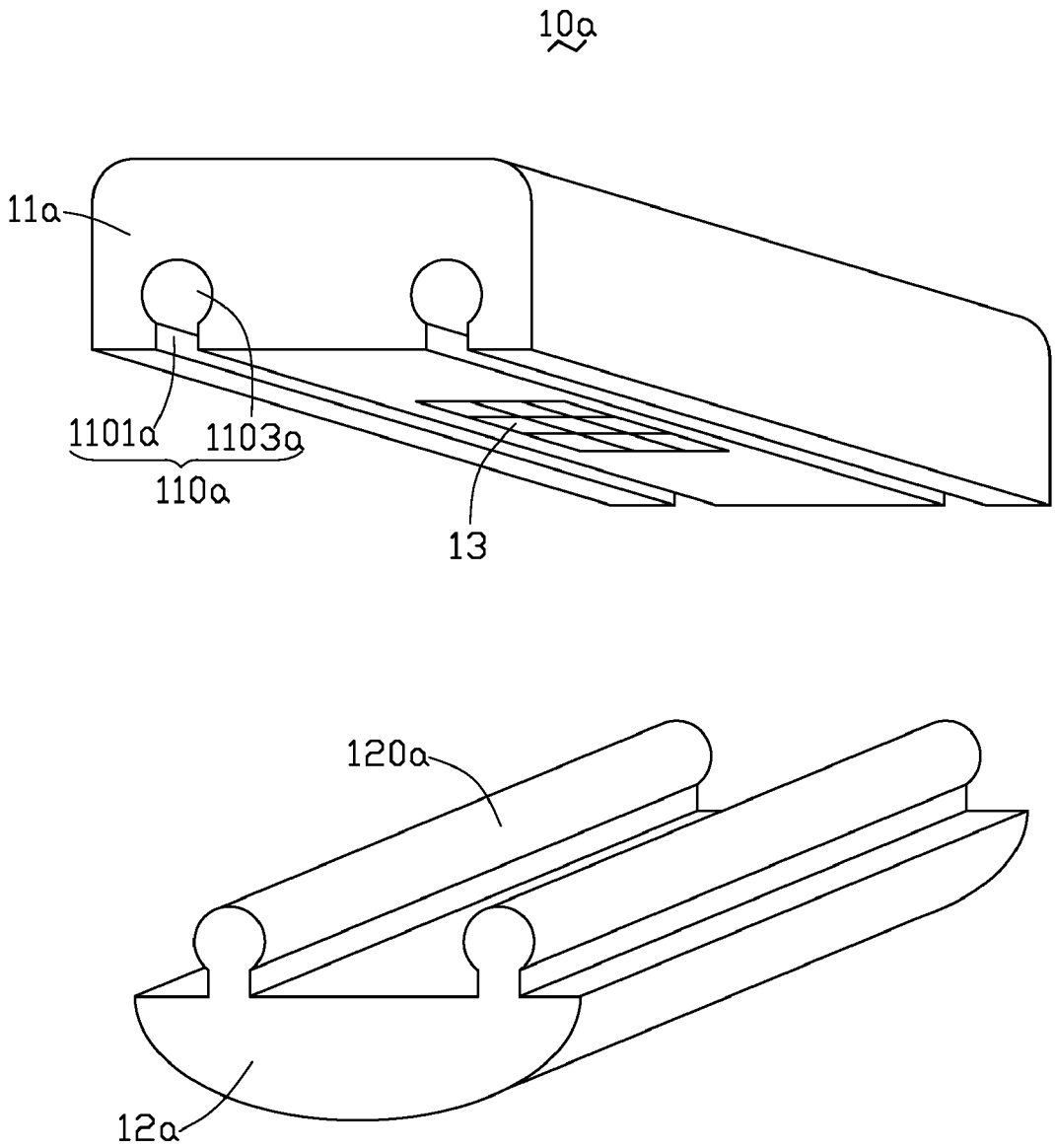
FIG. 4 is an exploded view of an LED lamp in accordance with a second embodiment of the present invention.

Referring to FIG. 4, a LED lamp 10*a* of a second embodiment of the present invent is shown. The LED lamp 10*a* is similar to the LED lamp 10 of the first embodiment of the present invention. The LED lamp 10*a* comprises a lamp seat 11*a* and a lampshade 12*a* corresponding to the lamp seat 11*a*. The LED modules 13 are received in the centre of the lamp seat 11*a*. Two spaced grooves 110*a* are defined at opposite sides of a bottom portion of the lamp seat 11*a*. Each groove 110*a* is different from each groove 110 of the first embodiment. Each groove 110*a* has a bottom portion 1101*a* and a top portion 1103*a* extending upwardly from the bottom portion 1101*a*. The bottom portion 1101*a* is defined by two elongated spaced surfaces (not labeled). The top portion 1103*a* has an arc-shaped configuration. Two spaced protruding portions 120*a* protrude upwardly from opposite sides of the lampshade 12*a*. Each protruding portion 120*a* has a shape corresponding to each groove 110*a*. The protruding portions 120*a* are received in the grooves 110*a*.

Figure 5:
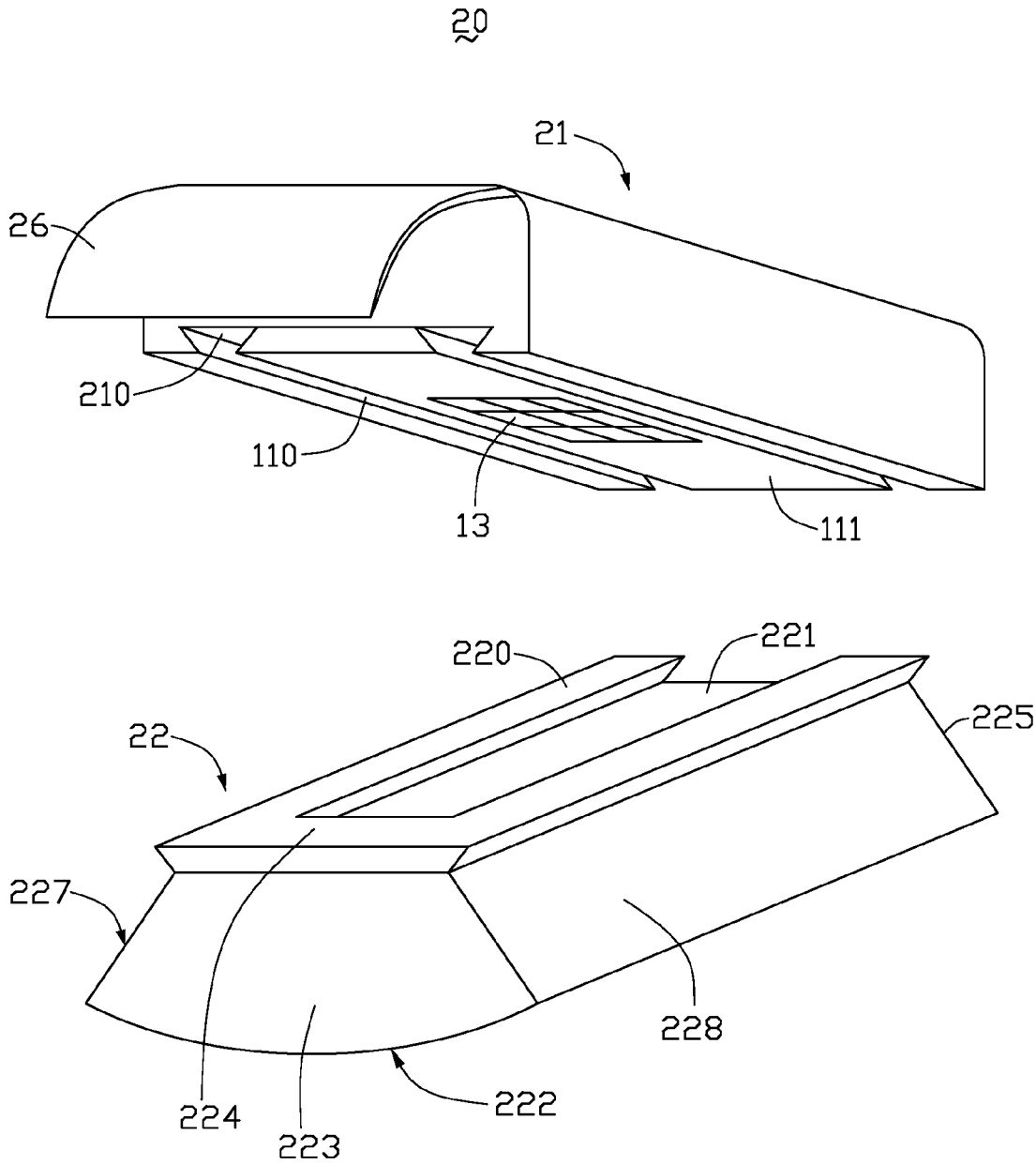
FIG. 5 is an exploded view of an LED lamp in accordance with a third embodiment of the present invention.

Referring to FIG. 5, a LED lamp 20 of a third embodiment of the present invent is shown. The LED lamp 20 comprises a lamp seat 21, a bent baffle-plate 26 extending downwardly and outwardly from a front end of the lamp seat 21 and a lampshade 22. The baffle-plate 26 is used to prevent contaminations from entering the LED lamp. The lamp seat 21 is similar to the lamp seat 11 of the first embodiment and has a bottom surface 111 and defines two grooves 110, but further defines a groove 210 at the front end thereof. The groove 210 communicates with the grooves 110. The lampshade 22 is different from the lampshade 12 of the first embodiment. The lampshade 22 has a configuration generally like a frustum. The lampshade 22 comprises a flat top surface 221, two flat lateral surfaces 227, 228 extending slantwise from lateral edges of the top surface 221, an arc-shaped front surface 223, an arc-shaped rear surface 225 and an arc-shaped bottom surface 222. The front and the rear surfaces 223, 225 extend slantwise from the front and rear edges of the top surface 221. The lateral surfaces 227, 228 and the front and rear surfaces 223, 225 are substantially coated with reflective films (not shown), thus, the lateral surfaces 227, 228 and the front and rear surfaces 223, 225 function as four reflectors to reflect light produced by the LED modules 13. Two protruding portions 220 protrude upwardly from lateral edges of the top surface 221. Each protruding portion 220 is the same as each protruding portion 120 of the first embodiment and is received in each groove 110 of the lamp seat 21. The protruding portions 220 connect with each other via a crossbeam 224 protruding upwardly from the front edge of the top surface 221. The crossbeam 224 is received in the groove 210.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a lamp seat having a bottom surface, the lamp seat defining a groove and a receiving chamber on the bottom surface;

a lampshade covering the lamp seat, the lampshade having a top surface and forming a protruding portion on the top surface slidably engaged in the groove of the lamp seat, and the top surface intimately contacting with the bottom surface; and a plurality of LED modules fittingly received in the receiving chamber, for emitting light into the lampshade through the top surface and to traverse out from the lampshade.

2. The LED lamp as claimed in claim 1, wherein the lampshade is light-pervious for transmitting the light emitting from the LED modules to an exterior.

3. The LED lamp as claimed in claim 2, wherein the lampshade comprises a front surface and a rear surface, the front and rear surface are coated with reflective films respectively.

4. The LED lamp as claimed in claim 3, wherein the lampshade comprises two lateral surfaces and the lateral surfaces are coated with reflective films respectively.

5. The LED lamp as claimed in claim 2, wherein the lampshade comprises a bottom surface, and a transparent layer is formed on an outside of the bottom surface.

6. The LED lamp as claimed in claim 5, wherein a photosensitive layer is formed on an outside of the transparent layer.

7. The LED lamp as claimed in claim 5, wherein the transparent layer is made from silicon or Al2O3.

8. The LED lamp as claimed in claim 2, wherein a baffle-plate extends outwardly and downwardly from a front end of the top surface to prevent from dust particles entering into the LED lamp.

9. The LED lamp as claimed in claim 1, wherein a material of the lampshade is selected from polymethylmethacrylate, poly carbonate, silicone, epoxy and polycrylate or a glass containing a material selected from the group consisting of ZnO, $B_2O_3$, $SiO_2$, $Nb_2O_3$, $Na_2O$, and $Li_2O_5$.

10. An LED lamp comprising:

a lamp seat having a flat surface, a receptacle defined in the flat surface and two parallel trapezoidal grooves defined in the flat surface;

a lampshade including a flat surface and two parallel trapezoidal protruding portions formed on the flat surface thereof and slidably engaged in the grooves of the lamp seat, widest parts of the protruding portions being farthest from the flat surface of the lampshade, the flat surface of the lamp seat intimately contacting with the flat surface of the lampshade; and a plurality of LED modules fittingly received in the lamp receptacle and facing toward the lampshade.

* * * * *